US007097411B2

(12) United States Patent
Smoke et al.

(10) Patent No.: US 7,097,411 B2
(45) Date of Patent: Aug. 29, 2006

(54) TURBOMACHINE COMPRESSOR SCROLL WITH LOAD-CARRYING INLET VANES

(75) Inventors: Jason C. Smoke, Phoenix, AZ (US); Cristopher Frost, Scottsdale, AZ (US); Richard D. Kocher, Tempe, AZ (US); Jeff D. Guymon, Gilbert, AZ (US); Ly D. Nguyen, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 120 days.

(21) Appl. No.: 10/829,114

(22) Filed: Apr. 20, 2004

(65) Prior Publication Data

US 2005/0232762 A1 Oct. 20, 2005

(51) Int. Cl.
*F01D 1/02* (2006.01)
*F04D 29/44* (2006.01)

(52) U.S. Cl. ..... 415/1; 415/204; 415/206; 415/211.2

(58) Field of Classification Search ..... 415/211.2, 415/204, 206, 1; 29/889
See application file for complete search history.

(56) References Cited

U.S. PATENT DOCUMENTS 3,963,369 A 6/1976 Balje
4,248,566 A 2/1981 Chapman et al.
4,302,150 A * 11/1981 Wieland ..... 415/207
4,378,194 A 3/1983 Bandukwalla
4,770,605 A 9/1988 Nakatomi
5,143,680 A 9/1992 Molnar et al.
5,178,516 A * 1/1993 Nakagawa et al. ..... 415/208.3
5,235,803 A * 8/1993 Rodgers ..... 60/785
5,947,680 A 9/1999 Harada et al.
6,168,375 B1 1/2001 La Rue et al.
6,183,195 B1 2/2001 Tremaine
6,607,353 B1 * 8/2003 Masutani ..... 415/161

* cited by examiner

*Primary Examiner*—Edward K. Look
*Assistant Examiner*—Devin Hanan
(74) *Attorney, Agent, or Firm*—Ingrassia Fisher & Lorenz

(57) ABSTRACT

A compressor scroll housing for use in conjunction with turbo-machinery, particularly applicable in aircraft. The scroll housing can include a plurality of scroll vanes arrayed around the scroll housing. Scroll vanes, integrally formed with the scroll housing, carry stress load on the scroll housing, including the load from fluid pressure within the scroll and carcass loading from the engine. The plurality of scroll vanes adapted for guiding flow of fluid from an inlet to an outlet while supporting the scroll housing. Chord length and cross sectional area of each scroll vane can be sized to maintain an equal stress in all scroll vanes. A method of making the scroll housing for use with an impeller connected to an engine is disclosed, as well as a method of operating turbo-machinery including supporting a load on the scroll housing with scroll vanes while maintaining an equal stress on each scroll vane.

30 Claims, 5 Drawing Sheets

TURBOMACHINE COMPRESSOR SCROLL WITH LOAD-CARRYING INLET VANES

GOVERNMENT RIGHTS

This invention was made with Government support under contract number N00019-01-C-3002 awarded by the United States Government under the JSF program to Lockheed Martin. The Government has certain rights in this invention.

BACKGROUND OF THE INVENTION

The present invention relates generally to turbo-machinery that must be both powerful and that must carry structural loads in aircraft applications. More specifically, the present invention relates to apparatus and methods relating to a scroll housing for use with a compressor.

In aviation applications, it is necessary to provide compressed air from the aircraft engines to the aircraft. Gas turbine engine aircraft may utilize an auxiliary power unit (APU) to provide air both when an aircraft is on the ground and when it is in flight. Air can be taken from an engine to pressurize or to otherwise condition the cabin air or, for example, to cool avionics equipment. In these aviation applications, there is a constant drive to both improve performance and to reduce the weight of components.

In aviation applications, a centrifugal compressor can be used to compress air. In these cases, the compressor discharge scroll must also be capable of supporting a variety of loading stresses that will occur. Specifically, a compressor scroll must be able to support dynamic loading from the aircraft environment, and pressure loading from the pressurization of air that occurs from the compressor itself.

U.S. Pat. No. 4,378,194 (the '194) shows one method of supporting these loads. In the '194 patent, there can be carcass loads that will develop between the forward and aft sections of the aircraft engine. The scroll housing surrounding the centrifugal compressor impeller is designed with a wall thickness that is great enough to handle these stress loads as well as the stress that will develop from air pressurized within the scroll. This is a common approach and one that works in some applications, although the weight of the heavy scroll wall and space restrictions limits the applicability of this approach.

U.S. Pat. No. 3,963,369 discloses another centrifugal compressor that will withstand the stresses in an aviation environment. Through-bolts are installed through the diffuser, which surrounds the impeller. The bolts are laid out in a circular pattern surrounding the impeller. The through-bolts serve to transmit engine carcass loads through the compressor housing. The greater the design loads, the more through-bolts are used to carry the load. Bolts passing through the diffuser work in some applications, but their use is generally limited to applications in which their presence does not limit performance. As performance requirements push the need for greater airflow and reduced weight, through-bolts become a limiting factor in the design. The through-bolt design also has the problem of increased part count and tolerance buildup associated with the increased part count. Tolerance build up can occur when multiple parts must fit together in an assembly such as the through bolt compressor housing which has a plurality of through-bolts as well as at least two housing halves to be assembled.

FIG. 1 shows a portion of a prior art turbo-machine including a scroll housing 100 designed so that all structural loads, including engine carcass loads, are carried solely by the scroll housing outer wall. In this design, the load path is contained in the scroll housing wall and does not cross the airflow path. This design requires a scroll housing wall thick enough to support all loading on the scroll housing 100. A direct load path S2 is required to maintain wall stresses comprising primarily tensile and shear components. In this prior art, as scroll wall 102 curvature between flanges 104 and 106 increases, bending stress becomes more predominant, and since bending is a less efficient means of supporting loads, material must be added to the scroll wall 102 in order to maintain adequate strength and stiffness, thus adding unwanted weight to the scroll housing 100. The need to keep the scroll wall 102 relatively flat limits the size of the scroll flow path. As the scroll wall 102 gets more of a bulge, it must get thicker to remain stiff enough, thus the weight increases. So, minimizing weight leads to minimizing curvature, which puts limits on scroll size relative to the flange diameters of the scroll. If the size of the flanges 104, 106 are increased to minimize curvature, then weight and installation are adversely impacted. A scroll wall 102 is thick enough to carry all structural loading transmitted between a forward flange 104 and an aft flange 106. The load path S2 is entirely contained within scroll wall 102. The scroll vanes 110 guide airflow A2 but carry no structural load and are outside the load path S2. This design also requires at least two housing piece parts, leading to greater weight, cost, and tolerance buildup associated with fitted parts.

FIG. 2 shows a portion of another prior art turbo-machine including a scroll housing 200 where bolts, passing through the diffuser, carry all the structural loads including engine carcass load. The through-bolt design requires diffuser vanes that are wide enough to accommodate the through-bolts. In many gas turbine engines the diffuser vanes are not large enough to accommodate the through-bolts. Through-bolts 202 carry all structural load, indicated by load path S3, between a forward flange 204 and an aft flange 206. Scroll vanes 210 guide air and can carry some of the pressure load S4 generated by airflow A3 within scroll housing 200 itself. Scroll vanes 210 are outside the structural load path S3, and the scroll wall 212 will carry no structural load.

As can be seen, there is a need for an improved scroll discharge housing for a centrifugal compressor and a method of making the scroll housing for use with an impeller. There is a need for a compressor discharge scroll housing design that maximizes performance while minimizing weight and part count. There is also a need for a compressor discharge scroll housing that allows for optimum air flow performance while being designed to withstand essentially all the stresses associated with pressure and engine carcass loads.

SUMMARY OF THE INVENTION

In one aspect of the present invention, there is provided a scroll housing for use in conjunction with a fluid compressor. The compressor has an inlet adapted to receive a flow of fluid. The scroll housing can include a scroll shaped outer wall, an outlet and a plurality of scroll vanes integrally formed with the scroll-shaped outer wall. The aft flanges, and plurality of scroll vanes connect the forward and aft flanges and the plurality of scroll vanes are adapted for guiding the flow of fluid from the inlet to the outlet while supporting the scroll housing.

In another aspect of the invention, a compressor includes a scroll housing, the compressor comprising an impeller, the scroll housing having a scroll shaped outer wall; an inlet adapted for receiving a fluid from the impeller; and a plurality of scroll vanes integrally formed with the scroll shaped outer wall, wherein the plurality of scroll vanes are adapted for guiding the flow of fluid from the inlet to an outlet, and wherein the plurality of scroll vanes are further adapted for supporting said scroll housing.

In a still further aspect of the invention, a turbo-machine includes a scroll housing, a scroll shaped outer wall, and a forward flange and an aft flange formed on said scroll shaped outer wall. A plurality of scroll vanes integrally formed with the scroll shaped outer wall and the forward and aft flanges, each of the scroll vanes including a leading edge and a trailing edge, and the scroll vanes adapted for guiding the airflow through the scroll housing while the scroll vanes support the scroll housing.

In yet another aspect of the invention, a scroll housing for use in combination with an air compressor comprises a scroll shaped outer wall, a forward flange and an aft flange formed on the scroll shaped outer wall. A plurality of scroll vanes can be integrally formed with the scroll shaped outer wall and with the forward and aft flanges, each of the plurality of scroll vanes including a leading edge and a trailing edge, each of the plurality of scroll vanes guiding a flow of air through the scroll housing while supporting the scroll housing.

In another aspect of the invention, a method is disclosed of making the scroll housing for use with an impeller connected to an engine, wherein the method includes determining the optimum size and shape characteristics for the scroll housing. The method also includes calculating loads on a scroll shaped outer wall of the scroll housing, and designing a plurality of scroll vanes to support the scroll shaped outer wall based on calculating the loads. The method includes casting the scroll housing and scroll vanes as one piece.

In yet another aspect of the invention a method of operating the turbo-machinery is disclosed that includes providing an airflow with an impeller and guiding airflow through a scroll housing using a plurality of scroll vanes integrally cast with the scroll housing while supporting a load on a scroll housing with scroll vanes and maintaining an equal stress on each scroll vane.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention is directed to an integral, one-piece scroll housing that includes scroll vanes designed to support all the loads typically transmitted by a scroll housing of compressors used in aircraft. These scroll vanes allow for a scroll housing design that can be optimized for performance in terms of both airflow and strength.

The scroll housing of the present invention provides a one-piece design where scroll vanes can carry all structural loading including engine carcass load. The present invention does not require diffuser through bolts or a thick scroll housing outer wall to carry structural loading. This is in contrast to the prior art, which require either a plurality of through bolts or a scroll housing outer wall having a thickness great enough to carry all structural loading.

Figure 1:
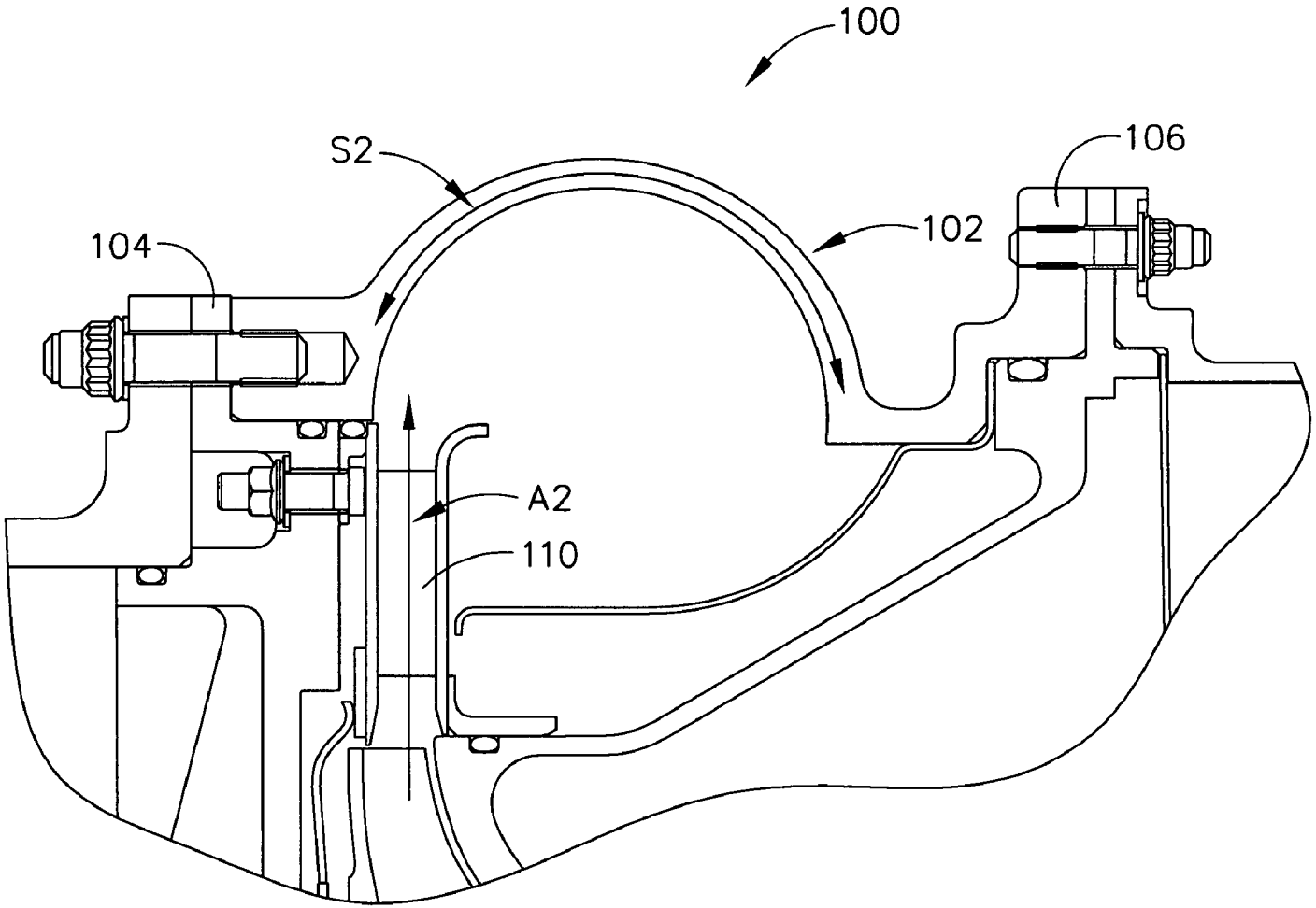
FIG. 1 (PRIOR ART)
FIG. 1 is a sectional view of a portion of a prior art turbo-machine.
Figure 3:
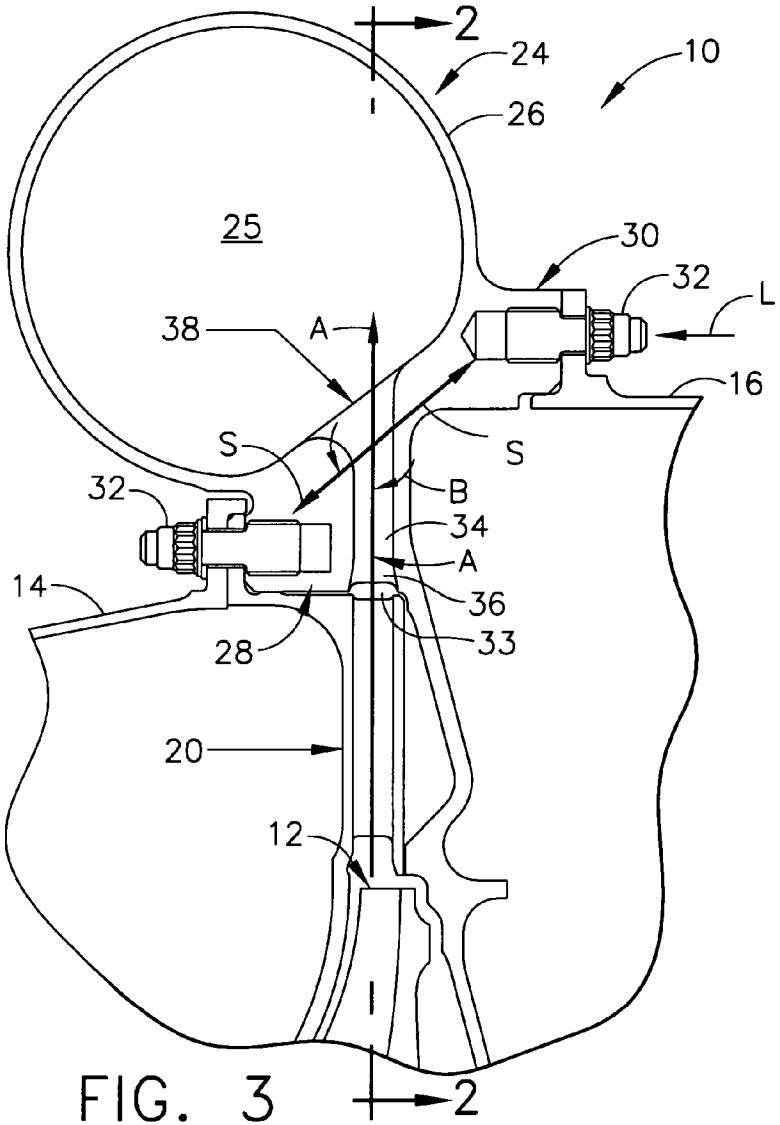
FIG. 3 is a sectional view of a portion of a turbo-machine including a compressor, according to one embodiment of the present invention.
Figure 2:
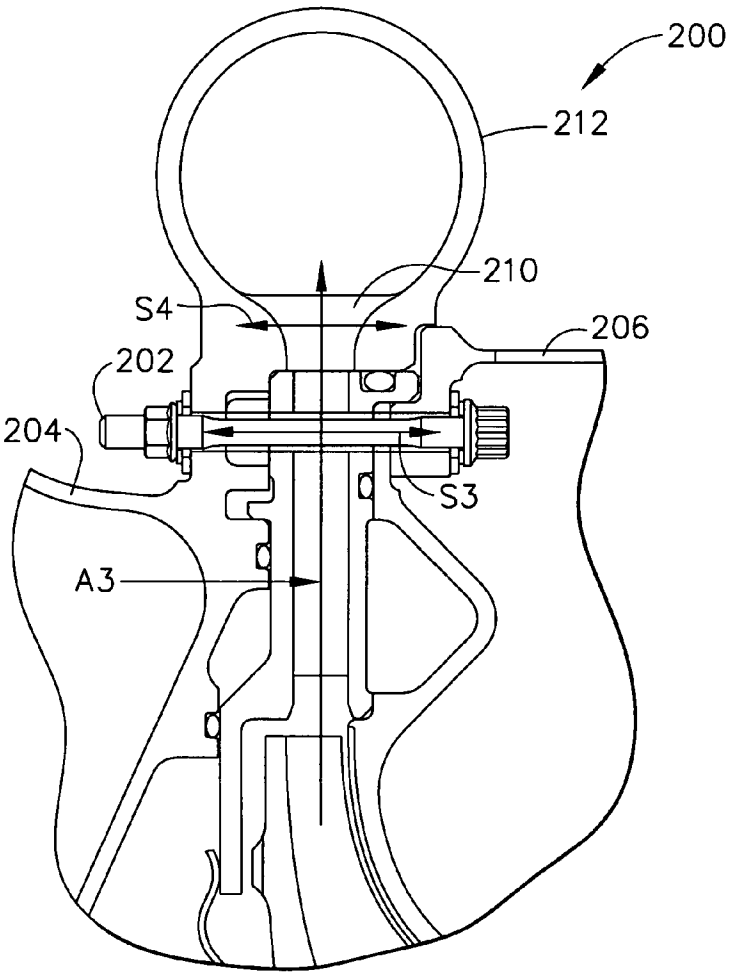
FIG. 2 (PRIOR ART)
FIG. 2 is a sectional view of a portion of an alternative prior art turbo-machine.

Referring now to FIG. 3, a compressor 10 can include an impeller 12 which can create a flow A of a fluid such as air. The compressor 10 can be disposed between a forward engine housing 14 and an aft engine housing 16. Airflow A from impeller 12 can travel radially outwardly through a diffuser 20. Airflow A can leave diffuser 20 and travel radially into the scroll housing 24. Scroll housing 24 may include an air flow path cross sectional area 25 which increases in cross sectional area in the direction of flow A around scroll housing 24. Scroll housing 24 may include a scroll shaped outer wall 26 and a forward flange 28 connecting compressor 10 to the forward engine housing 14. Scroll housing 24 may also include an aft flange 30 connecting compressor 10 to the aft engine housing 16. Forward and aft flanges 28, 30 can be connected to forward and aft engine housings 14, 16, respectively, by a plurality of fasteners such as studs or bolts 32.

Figure 5:
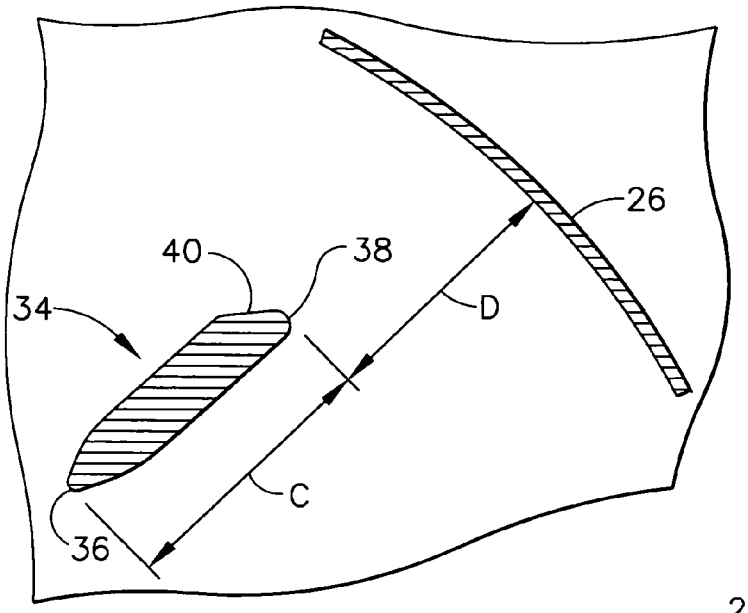
FIG. 5 shows detail of a scroll vane of the compressor scroll of FIG. 4.

Scroll vanes 34 may guide airflow A from diffuser 20, across inlet 33, and into scroll housing 24. Vanes 34 may be integrally formed with scroll housing 24, and can include a leading edge 36 and a trailing edge 38 (FIG. 5). As can be seen, trailing edge 38 can be tilted with respect to plane 2—2 of the impeller 12, at an angle B. With trailing edge 38 tilted at angle B, aft flange 30 can be radially outward from forward flange 28.

FIG. 3 shows that load path S from loading L from aft housing 16 to forward housing 14 cuts across airflow A. For example, if aft engine housing 16 applies a compressive force L to aft flange 30, that compressive force would carry through scroll vane 34 and into forward flange 28. Forward flange 28 and aft flange 30 carry the load L, which is transmitted from one of forward flange 28 and aft flange 30 to the other flange (forward flange 28 or aft flange 30) through scroll vane 34.

Figure 4:
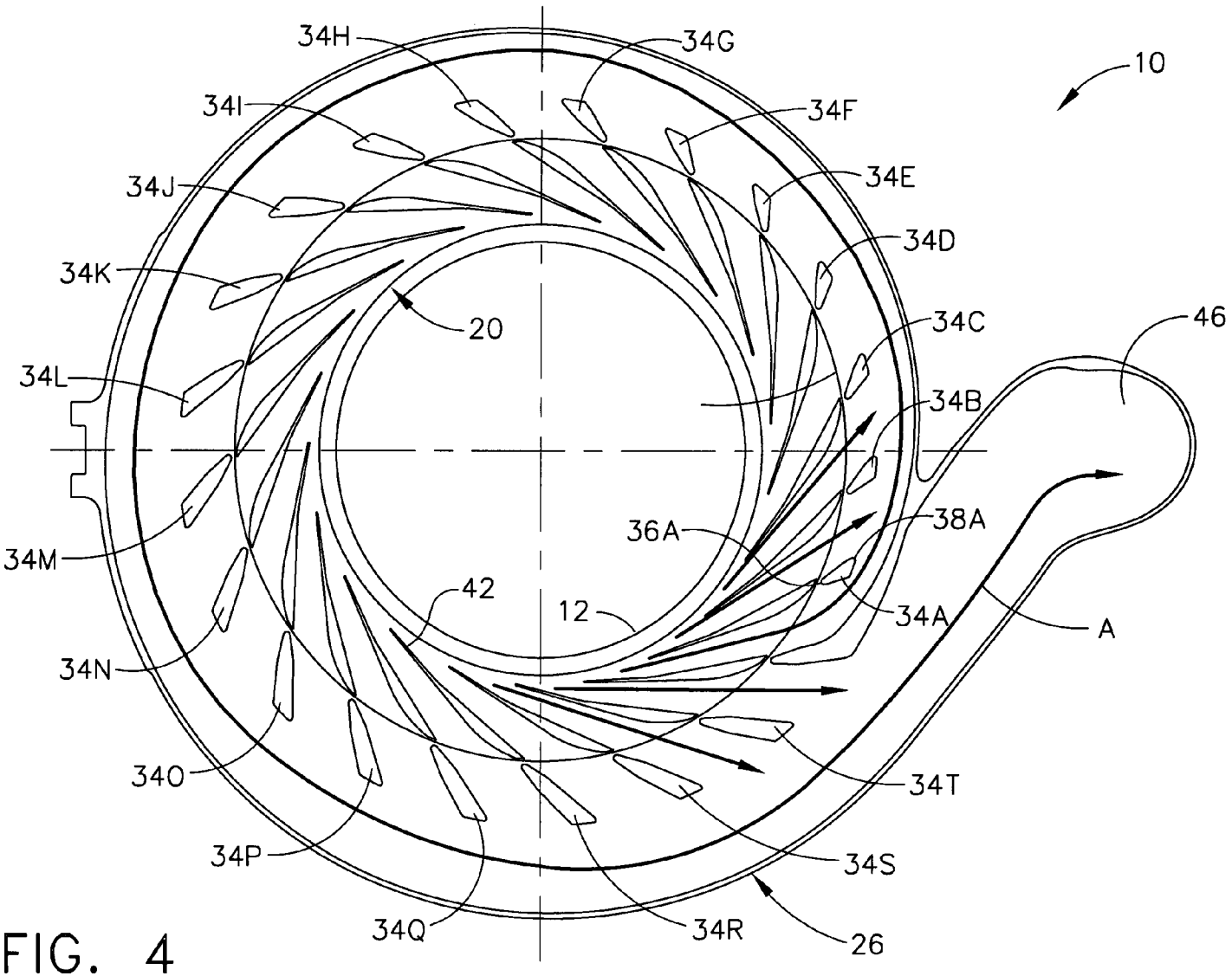
FIG. 4 is a cross sectional view of the compressor scroll and diffuser of FIG. 3.

FIG. 4 shows a cross section of compressor 10 taken through the plane of impeller 12. Airflow A from impeller 12 can enter diffuser 20. Diffuser vanes 42 can guide airflow A through diffuser 20 and into scroll housing 24. There can be a plurality of scroll vanes 34A through 34T in this embodiment of the invention. Other embodiments of the present invention may have other numbers or configurations of scroll vanes 34. Scroll vanes 34A–T can start with a smallest cross-section vane 34A and proceed to largest cross-section vane 34T. Cross-sectional area 40 of each scroll vane 34A–T can be designed to carry the local load experienced by that vane. For example, vane 34A can be relatively small because the pressure of airflow A at the trailing edge 38A of vane 34A is relatively small, and because the scroll shaped outer wall 26 is relatively thicker adjacent this vane 34A. As viewed from FIG. 4, proceeding clockwise about scroll shaped outer wall 26, scroll vanes 34 get progressively larger as air flow pressures increase and as the distance, D in FIG. 5, of scroll shaped outer wall 26 from trailing edges 38 of scroll vanes 34 gets larger. Maximum vane loading can typically occur in those vanes 34 near the compressor outlet 46 where pressure from airflow A and distance from scroll shaped outer wall 26 can be maximum. It will be understood that cross sectional area 40 of each scroll vane 34A–T may be designed to carry the local loading experienced by that scroll vane 34A–T. Scroll housing 24 and scroll vanes 34 may be designed such that each scroll vane 34A–T experiences an equal level of stress, individual scroll vane 34 can be sized according to local loading thus minimizing material weight.

Referring now to FIG. 5, for each scroll vane 34A–T, the distance from leading edge 36 to its trailing edge 38 is the chord length C for that vane 34. Chord length C and scroll vane 34 cross sectional area 40 can increase for scroll vanes 34 in areas of high loading. The distance D is from trailing edge 38 of scroll vane 34 to scroll shaped outer wall 26. Distance D can vary for each scroll vane 34, and in the embodiment shown increases in the clockwise direction of scroll shaped outer wall 26 as shown. In an exemplary embodiment, scroll vanes 34 get progressively larger as air flow path cross sectional area 25 within scroll shaped housing 26 gets larger.

Scroll housing 24, including all scroll vanes 34A–T, forward and aft engine flanges 28 and 30, and scroll shaped outer wall 26, can be formed as one piece, i.e., integral. Typically, scroll housing 24 can be formed as a casting. Scroll housing 24 can be formed, for example, by sand casting. Scroll vanes 34 may be used as-cast. Certain portions, such as forward and aft flanges 28, 30, may require machining. Unlike the prior art, which uses a scroll housing thick enough to support all loading, or through-bolts to withstand pressure loads and engine carcass loads, scroll vanes 34 of the present invention can carry most, if not all, of the structural loading experienced by compressor 10. For example, scroll vanes 34 can typically carry 70 to 100% of the load, and more typically can carry 98–100% of the load, including engine carcass load and pressure load. In practice, scroll vanes 34 may be designed to carry 100% of the load plus any safety factors that might be applied, whereas scroll shaped outer wall 26 may carry, at most a small percent of the actual load. For example, scroll shaped outer wall 26 may typically carry less than 30% of the load, and more typically may carry less than 2% of the load. In aircraft applications, scroll housing 24 may be cast from a material such as titanium.

Figure 6:
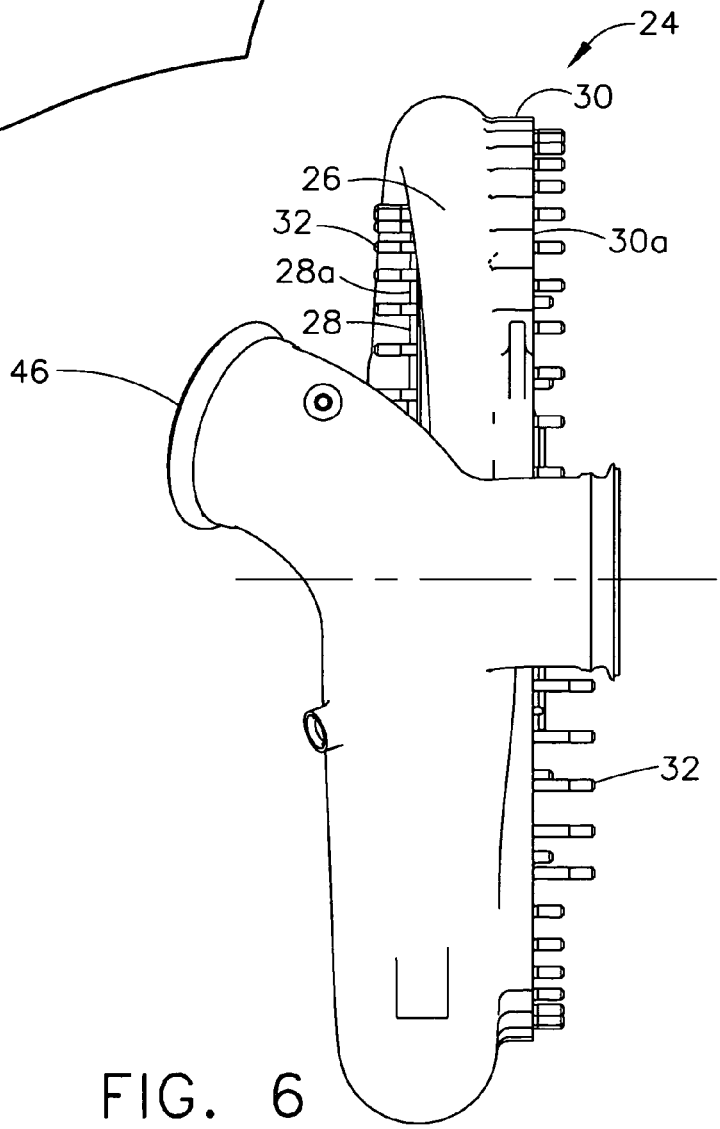
FIG. 6 is a perspective view of a compressor scroll as seen from the outside, also according to the present invention.

FIG. 6 shows the exterior of scroll housing 24 as seen from the side. As can be seen in this view, forward and aft engine flanges 28 and 30 may be circular and can extend around scroll shaped outer wall 26. Surfaces 28*a* and 30*a* of forward and aft engine flanges 28 and 30, respectively, can be machined flat surfaces that will allow scroll housing 24 to mate with adjacent engine housings 14 and 16 shown in FIG. 3.

Figure 7:
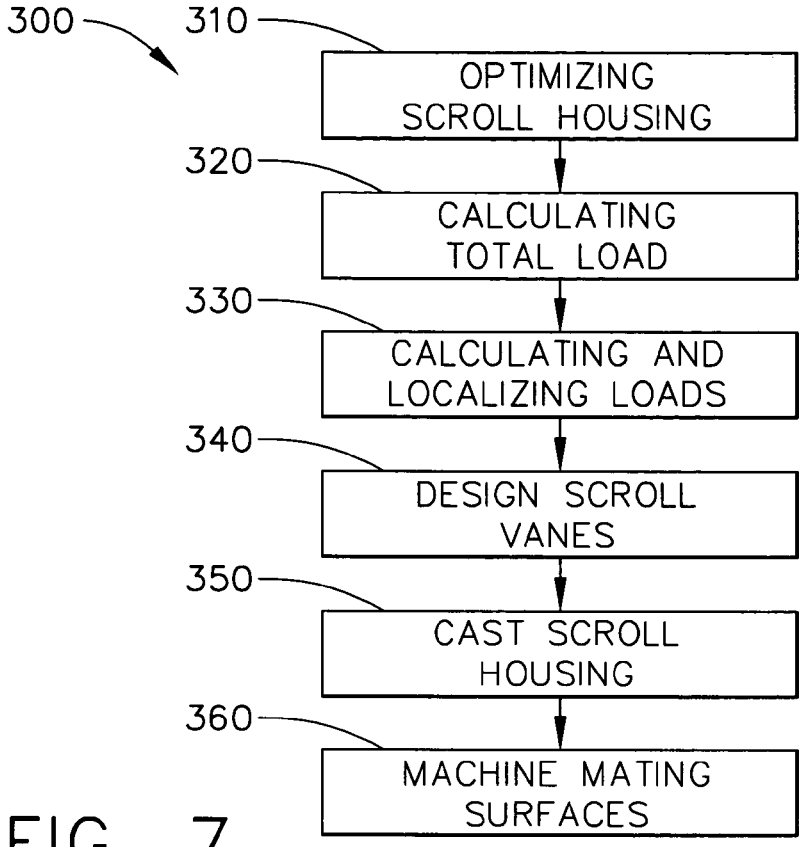
FIG. 7 is a flowchart of the method of making a compressor discharge scroll housing according to one embodiment of the present invention.

Referring now to FIGS. 5 and 7, a method 300 of making a one-piece (integral) scroll housing 24 is shown. Scroll shaped outer wall 26, and plurality of scroll vanes 34A–T formed integrally therewith, may be designed by a step 310 of optimizing scroll housing 24 to allow for the required performance of compressor 10 with respect to parameters such as air flow speed, temperature, pressure, and air volume. The optimum characteristics for scroll shaped outer wall 26 can be based on one or several operating modes such as, for example, on ground and in-flight operation of compressor 10. The next step 320 may involve calculating the total loading on scroll housing 24. In step 320, the total loading that will occur from engine carcass loads and from airflow pressure load and from other loading, such as shock loading, can be calculated. The loading can be calculated and localized, according to step 330, across scroll shaped outer wall 26, and then scroll vanes 34A–T can be designed in step 340 with a chord length C, distance D to scroll shaped outer wall 26 and cross sectional area 40 sufficient to carry the calculated localized loading. It will be obvious that additional calculations based on, for example, a desired safety factor or life factor, can also be included in determining the required cross sectional area 40 of each scroll vane 34A–T. Once a design for scroll housing 24 is complete, the next step can be casting step 350 to cast scroll housing 24 as a single piece. The casting step 350 can be, for example, investment or sand casting. Thereafter the next step 360 can be machining mating surfaces 28*a* and 30*a*.

Figure 8:
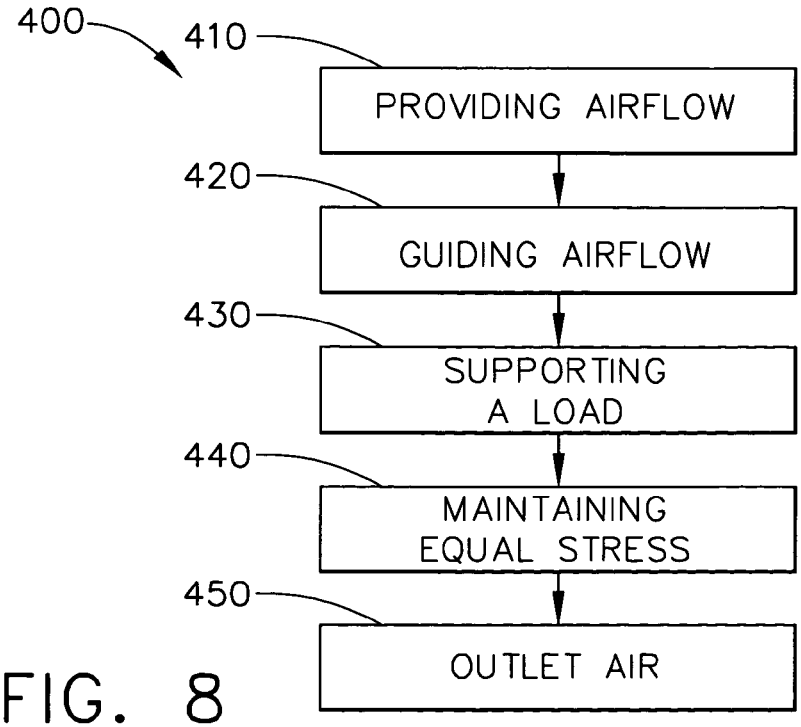
FIG. 8 is a flowchart of the method of utilizing a compressor discharge scroll housing according to one embodiment of the present invention.

FIG. 8 shows a method 400 of operating compressor 10. Method 400 includes the step 410 of providing airflow from impeller 12. Then the method 400 includes a step 420 of guiding the airflow into and through scroll housing 24 using scroll vanes 34A–T. Step 430 may involve supporting, via scroll vanes 34A–T, a load applied to scroll housing 24 as air flows through scroll housing 24. As the load is applied to scroll housing 24, step 440 may involve maintaining an equal stress on each scroll vane 34A–T. That is to say, the stress in each scroll vane 34 is designed to be substantially equal to the stress in every other scroll vane 34 as load is applied. By equalizing the stress each scroll vane 34 experiences according to step 440, the total weight requirement of scroll housing 24 may be minimized. In step 450, air may be outlet from scroll housing outlet 46.

Though shown and described herein with respect to use in an aircraft, it will be understood that scroll housing compressor 10 of the present invention may also be used in other applications. It will also be understood that though the embodiment shown has a scroll with scroll vanes 34A–T getting larger in a clockwise direction, the size, location and orientation of each vane can be determined to meet stress loading on the scroll housing. Also it will be understood that the number of scroll vanes used can vary depending upon design requirements.

It should be understood, of course, that the foregoing relates to exemplary embodiments of the invention and that modifications may be made without departing from the spirit and scope of the invention as set forth in the following claims.

We claim:

1. A scroll housing for use in conjunction with a fluid compressor comprising:

an inlet adapted to receive a flow of fluid;

a scroll shaped outer wall;

a forward flange and an aft flange fanned on said scroll shaped outer wall;

an outlet; and a plurality of scroll vanes integrally formed with said scroll shaped outer wall and extending between said forward and aft flanges, and said plurality of scroll vanes connecting said forward and aft flanges, said plurality of scroll vanes adapted for guiding the flow of fluid from said inlet to said outlet while supporting said scroll housing and configured such that an equal stress is maintained on each scroll vane when a load is applied to the scroll shaped outer wall.

2. The scroll housing of claim 1, wherein each of said plurality of scroll vanes has a leading edge and a trailing edge, said leading edge and said trailing edge are separated by a chord length, wherein said chord length enables at least one of said plurality of scroll vanes to carry a load upon said scroll housing adjacent each of said plurality of scroll vanes.

3. The scroll housing of claim 1, wherein at least one of said plurality of scroll vanes has a cross sectional area, wherein said cross sectional area carries a load upon said scroll housing adjacent each of said plurality of scroll vanes.

4. The scroll housing of claim 1, wherein said plurality of scroll vanes carry a portion of a load on said scroll housing, said portion in the range of 70–100% of the load.

5. The scroll housing of claim 1, wherein said scroll housing is cast titanium.

6. The scroll housing of claim 1, wherein said fluid is air.

7. A compressor including a scroll housing, said compressor comprising:

an impeller;

said scroll housing having a scroll shaped outer wall;

a forward flange and an aft flange formed on said scroll shaped outer wall;

an inlet adapted for receiving a fluid from said impeller; and a plurality of scroll vanes integrally formed with said scroll shaped outer wall, wherein said plurality of scroll vanes are adapted for guiding the flow of fluid from said inlet to an outlet, and wherein said plurality of scroll vanes are further adapted for supporting said scroll housing and configured such that an equal stress is maintained on each scroll vane when a load is applied to the scroll shaped outer wall.

8. The compressor of claim 7, wherein said forward flange and said aft flange are circular.

9. The compressor of claim 8, wherein said forward flange and said aft flange each include a flat machined surface.

10. The compressor of claim 9, further including a diffuser disposed between said impeller and said scroll housing.

11. The compressor of claim 9, wherein said plurality of scroll vanes carry a portion of a load on said scroll housing, said portion in the range of 70–100% of the load.

12. The compressor of claim 7, wherein said plurality of scroll vanes carry a portion of a load on said scroll housing, said portion in the range of 98–100% of the load.

13. The compressor of claim 12, wherein said fluid is air and wherein said scroll housing is cast titanium.

14. A turbo-machine, comprising:

a compressor having a scroll housing;

a forward flange and an aft flange formed on said scroll shaped outer wall;

a forward engine housing and an aft engine housing, said compressor connected to said engine between said forward engine housing and said aft engine housing and an impeller;

wherein, said compressor including a plurality of scroll vanes for receiving fluid from said impeller, said plurality of scroll vanes integrally formed with said scroll shaped outer wall, and said plurality of scroll vanes adapted for guiding the flow of fluid from an inlet to an outlet while said plurality of scroll vanes support said scroll housing against loads from said forward engine housing and said aft engine housing and configured such that an equal stress is maintained on each scroll vane when a load is applied to the scroll shaped outer wall.

15. The turbo-machine of claim 14, wherein each of said plurality of scroll vanes has a cross sectional area, said cross sectional area designed to carry said loads, said loads including at least a carcass load between said forward engine housing and said aft engine housing, and a pressure load generated by fluid pressure from said impeller.

16. The turbo-machine of claim 15, wherein said integrally formed scroll shaped housing and said plurality of scroll vanes are formed by investment casting titanium.

17. The turbo-machine of claim 14, wherein said forward flange connecting said scroll shaped housing to said forward engine housing, and said aft flange connecting said scroll shaped outer wall to said aft engine housing.

18. The turbo-machine of claim 14, wherein each of said plurality of scroll vanes has a cross sectional area determined by a portion of said loads acting on said scroll shaped housing adjacent to each of said plurality of scroll vanes.

19. The turbo-machine of claim 17, wherein said forward flange includes a machined surface adapted to fit to said forward engine housing, and wherein said aft flange includes a machined surface adapted to fit to said aft engine housing.

20. The turbo-machine of claim 14, wherein each of said plurality of scroll vanes gets progressively larger as an air flow path in said scroll shaped housing increases in cross sectional area.

21. A scroll housing for use in combination with an air compressors, comprising:

a scroll shaped outer wall;

a forward flange and an aft flange formed on said scroll shaped outer wall;

a plurality of scroll vanes integrally fanned with said scroll shaped outer wall and with said forward and aft flanges, each of said plurality of scroll vanes including a leading edge and a trailing edge, each scroll vane of said plurality of scroll vanes guiding a flow of air trough said scroll housing while supporting said scroll housing and configured such that an equal stress is maintained on each scroll vane when a load is applied to the scroll shaped Outer wall.

22. The scroll housing of claim 21, wherein said each of said plurality of scroll vanes gets progressively larger in a radial direction around said scroll shaped outer wall.

23. The scroll housing of claim 21, wherein each of said plurality of scroll vanes is sized according to a local load distribution in said scroll housing.

24. The scroll housing of claim 22, wherein said plurality of scroll vanes carry 70–100% of a load transmitted between said forward flange and said aft flange.

25. A method of making a scroll housing for use with an impeller connected to an engine, including the steps of:

determining the optimum size and shape characteristics for the scroll housing;

calculating loads on a scroll shaped outer wall of said scroll housing;

based on said calculating loads step, designing a plurality of scroll vanes internal to said scroll shaped outer wall; and based on said designing step, casting said scroll housing and said plurality of scroll vanes as one piece.

26. The method of claim 25, wherein said casting is investment casting.

27. The method of claim 25, wherein said step of calculating loads includes the step of calculating local loads on the scroll shaped outer wall, and said step of designing a plurality of scroll vanes includes the step of determining the cross-sectional area of each of said plurality of scroll vanes to support said local loads.

28. The method of claim 26, wherein, based on said designing step, an equal stress occurs in each of said plurality of scroll vanes.

29. A method of operating turbo-machinery, including the steps of;

providing an airflow with an impeller;

guiding said airflow through a scroll housing using a plurality of scroll vanes integrally cast with said scroll housing; and supporting a load on said scroll housing with said plurality of scroll vanes, said plurality of scroll vanes configured such that an equal stress is maintained on each scroll vane when a load is applied to the scroll shaped outer wall by determining a chord length, cross sectional area and distance from a scroll housing wall for each of said plurality of scroll vanes.

30. The method of claim 29, wherein said scroll housing is cast in one piece.

* * * * *

UNITED STATES PATENT AND TRADEMARK OFFICE

CERTIFICATE OF CORRECTION

PATENT NO. : 7,097,411 B2
APPLICATION NO. : 10/829114
DATED : August 29, 2006
INVENTOR(S) : Smoke et al.

It is certified that error appears in the above-identified patent and that said Letters Patent is hereby corrected as shown below:

Column 8, line 34, “fanned” should be changed to --formed--;
Column 8, line 39 “trough” should be changed to --through--;
Column 8, line 42 “Outer” should be changed to --outer--.

Signed and Sealed this

Twenty-seventh Day of March, 2007

JON W. DUDAS
*Director of the United States Patent and Trademark Office*